US008074311B2

(12) United States Patent
Haynesworth

(10) Patent No.: US 8,074,311 B2
(45) Date of Patent: Dec. 13, 2011

(54) PRAYER PILLOW WITH MULTIFUNCTIONS

(76) Inventor: Noris Haynesworth, Newport News, VA (US)

( * ) Notice: Subject to any disclaimer, the term of this patent is extended or adjusted under 35 U.S.C. 154(b) by 0 days.

(21) Appl. No.: 12/905,110

(22) Filed: Oct. 15, 2010

(65) Prior Publication Data

US 2011/0088168 A1 Apr. 21, 2011

Related U.S. Application Data

(60) Provisional application No. 61/252,793, filed on Oct. 19, 2009.

(51) Int. Cl.
*A47G 9/10* (2006.01)

(52) U.S. Cl. ..... 5/652; 5/657; 5/640

(58) Field of Classification Search ..... 5/630, 632, 5/636, 640, 652, 657; 297/423.11, 423.41
See application file for complete search history.

(56) References Cited

U.S. PATENT DOCUMENTS

| | | | | |
|---|---|---|---|---|
| 3,604,026 | A * | 9/1971 | Scheips | 297/397 |
| 6,230,349 | B1 * | 5/2001 | Silver et al. | 5/636 |
| 6,748,615 | B1 * | 6/2004 | Tiedemann | 5/640 |
| 6,810,541 | B1 | 11/2004 | Woods | |
| 6,951,035 | B2 | 10/2005 | Kinchen | |
| 7,246,391 | B2 | 7/2007 | Brown | |
| 7,376,990 | B2 * | 5/2008 | Gooddine | 5/490 |
| 7,472,443 | B2 | 1/2009 | Littlehorn et al. | |
| 7,685,661 | B2 * | 3/2010 | Popilek et al. | 5/639 |
| 2003/0019007 | A1 | 1/2003 | Spencer | |
| 2006/0200910 | A1 | 9/2006 | Taylor | |

FOREIGN PATENT DOCUMENTS

| | | |
|---|---|---|
| CN | 201175197 | 1/2009 |
| CN | 101554282 | 10/2009 |
| DE | 4423570 | 7/1994 |
| JP | 2002045285 | 2/2002 |
| WO | WO9119443 | 12/1991 |

* cited by examiner

*Primary Examiner* — Fredrick Conley
(74) *Attorney, Agent, or Firm* — Thien Tran, Esq.; Access Patent Group, LL

(57) ABSTRACT

A multiple function pillow used for kneeling, sitting, sleeping and traveling which includes a cushion member and a protective cover. A mechanism is for removably inserting the cushion member into the protective cover, to allow a person to rest their head, back, sit and kneel thereon. A mechanism is for securing opposite ends of the protective cover together, wherein the cushion member can be folded into a closed position, so as to be wrapped and retained about a wrist of a person, a handle of a suitcase, a strap of a bag and a strap of a purse for easy transportation thereof. Two non-slip neoprene material pads are used.

6 Claims, 4 Drawing Sheets

PRAYER PILLOW WITH MULTIFUNCTIONS

CROSS-REFERENCE TO RELATED APPLICATION

This application claims the benefit of Provisional Patent Application No. 61/252,793, filed on Oct. 19, 2009, in the United States Patent & Trademark Office, the disclosure of which is incorporated herein by reference.

BACKGROUND OF THE INVENTION

1. Field of the Invention

The present invention relates to a pillow, and more particularly, a multiple function pillow. The pillow provides portable padding for use by consumers when kneeling, traveling, or sitting. Its versatile construction and compact size make it beneficial to anyone in need of extra support for their joints, back, neck or head. The pillow is made using a thick foam cushion member for increased comfort which provides enhanced cushioning for the user at any time. The pillow is equipped with a soft protective cover that is removable and washable. The present invention also features hook and loop file fastener Velcro straps that are used to temporally secure the pillow to the consumer's wrist, suitcase, bag or purse for easy transportation and storage.

2. Description of the Prior Art

There are many people who suffer from joint pain and other body aches. In some instances this pain may be caused by a lack of proper padding when an individual is sitting, kneeling or sleeping in an uncomfortable position for an extended duration. Many individuals who suffer from joint pain would prefer to kneel when they pray, however they may find this position to be uncomfortable due to the excessive pressure put on the knee joints. Conventional pillows may be immoderately bulky for a user to bring to church. Travel pillows may be used to comfort the head, however they are typically too small and soft for use with other body parts. A need exists to provide users with an improved, more versatile, and readily transportable pillow to furnish sufficient comfort and padding for its user.

Numerous innovations for cushions have been provided in the prior art that will be described. Even though these innovations may be suitable for the specific individual purposes to which they address, however, they differ from the present invention.

A FIRST EXAMPLE, U.S. Patent Office Publication No. 2003/0019007, Published on Jan. 30, 2003, to Spencer teaches a knee cushion support for placement atop a surface in an area beneath knees of a user comprising a covering that encloses the outer periphery of the cushion support. A pair of depressions formed in the upper surface of the cushion receives and supports the knees of a user while in the kneeling position. A resilient inner core member is enclosed within the outer covering. A convex shaped ridge member is located between a pair of depressions that accommodate the knee of a user. An essentially concave shaped portion formed integral with, and curved upward from the lower surface is aligned on the lower surface beneath the ridge member in an arrangement that will permit stacking of a number of knee cushion supports together in a nesting arrangement. A pair of handles or grips is formed on the first and second end-walls to facilitate grasping and transporting the knee cushion support.

A SECOND EXAMPLE, U.S. Pat. No. 6,810,541, Issued on Nov. 2, 2004, to Woods teaches a peanut-shaped cushion that is to be used to enhance the comfort of a person kneeling in prayer. The pillow is constructed from a single piece of thick foam material. The opposite ends of the foam are rounded. The mid-section is narrowed so that the foam piece resembles a peanut. The foam is wrapped with a polyester fiber cover and further disposed in a decorative casing, which casing is zippered for easy removal. The casing has a small pocket on one of its planar sides.

A THIRD EXAMPLE, U.S. Pat. No. 6,951,035, Issued on Oct. 4, 2005, to Kinchen et al. teaches a protective cushion which includes an outer shell enclosing a pad comprising high-density foam. The cushion provides protection to a user's knees, such as while praying or meditating. The outer shell of the cushion is water-resistant, stain-resistant, and able to withstand excessive wear and tear. Further, the outer shell comprises designs, pictures, and text to aid the user in prayer or other worship activities. The cushion can be foldable and portable with a carrying handle provided for this purpose.

A FOURTH EXAMPLE, U.S. Patent Office Publication No. 2006/0200910, Published on Sep. 14, 2006, to Taylor teaches a multi-article and multifunctional travel accessory that enables user-selective employ, either individually or in combination, of various articles of comfort, including a pillow, blanket, lumbar support, hand cozy, foot cozy, and/or seat cushion. The present invention is particularly characterized by its provision of a structurally compact or bundled arrangement of the foregoing listed articles; thereby, facilitating expeditious assembly, disassembly, and carriage of same.

A FIFTH EXAMPLE, U.S. Pat. No. 7,246,391, Issued on Jul. 24, 2007, to Brown teaches a prayer pillow, or cushion, which has knee pads placed in the interior of the pillow filling, spaced apart and adapted to receive the knees of a user while kneeling. The knee pads provide further cushioning and support for the knees of the user so that kneeling for a protracted time is more comfortable. The pillow has a removable cover that may, in preferred embodiments, incorporate a pleasant design and verses of Biblical scripture. The spacing between the knee pads maybe adjusted by the user.

It is apparent now that numerous innovations for cushions have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a multiple function pillow that avoids the disadvantages of the prior art.

ANOTHER OBJECT of the present invention is to provide a multiple function pillow that is simple and inexpensive to manufacture.

STILL ANOTHER OBJECT of the present invention is to provide a multiple function pillow that is simple to use.

BRIEFLY STATED, STILL YET ANOTHER OBJECT of the present invention is to provide A multiple function pillow used for kneeling, sitting, sleeping and traveling which comprises a cushion member and a protective cover. A mechanism is for removably inserting the cushion member into the protective cover, to allow a person to rest their head, back, sit and kneel thereon. A mechanism is for securing opposite ends of the protective cover together, wherein the cushion member can be folded into a closed position, so as to be wrapped and retained about a wrist of a person, a handle of a suitcase, a strap of a bag and a strap of a purse for easy transportation thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 7 is a diagrammatic perspective view of the present invention being used for the person to kneel on.

FIG. 8 is a diagrammatic perspective view of the present invention being used for the person to sit on.

REFERENCE NUMERALS UTILIZED IN THE DRAWING

Figure 1:
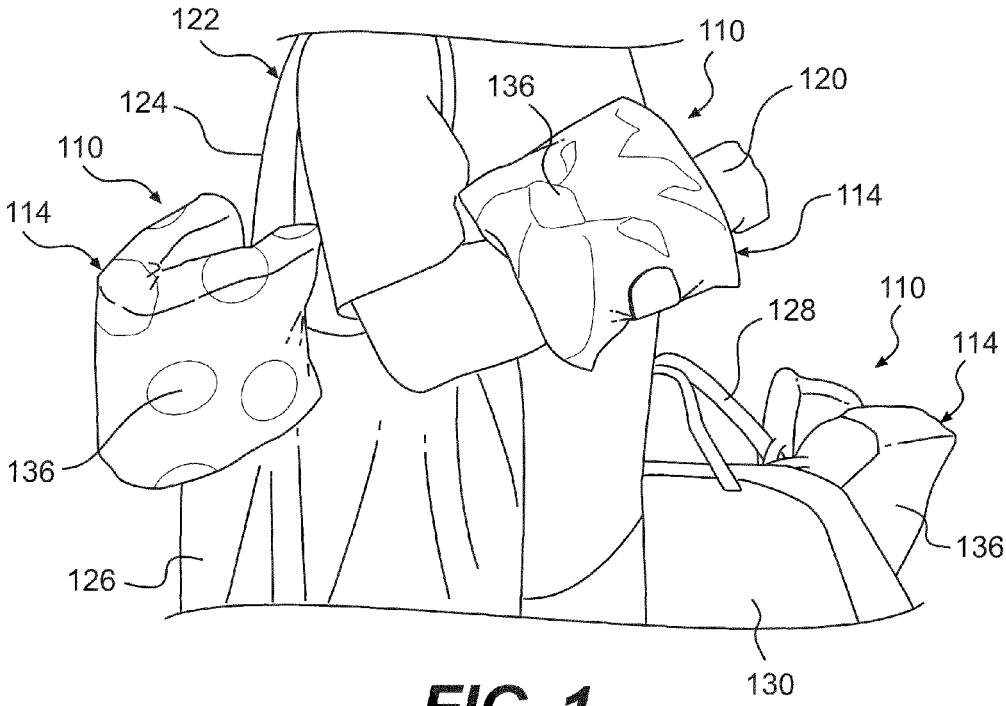
FIG. 1 is a diagrammatic perspective view showing the present invention being used when a person is traveling.
Figure 2:
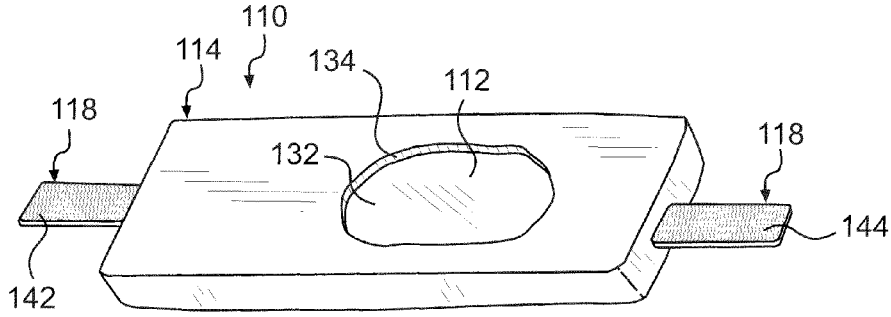
FIG. 2 is a diagrammatic top perspective view with parts broken away, showing the present invention in a flat position.
Figure 3:
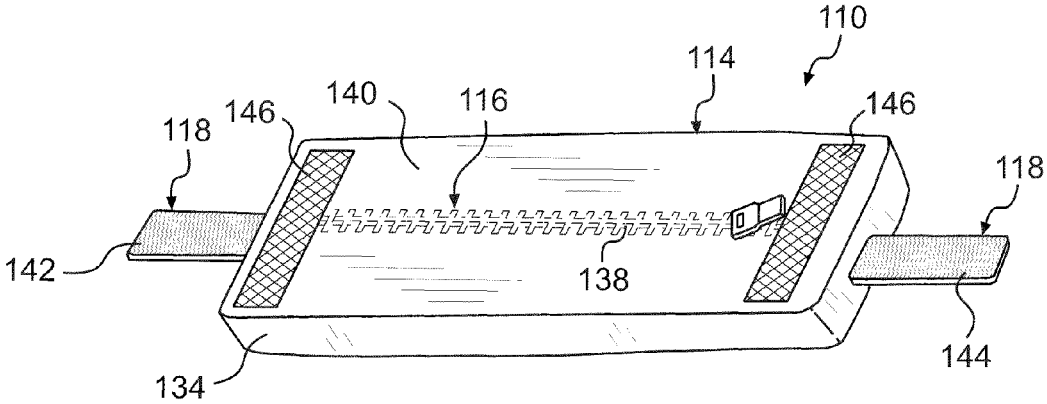
FIG. 3 is a diagrammatic bottom perspective view showing the present invention in a flat position.
Figure 4A:
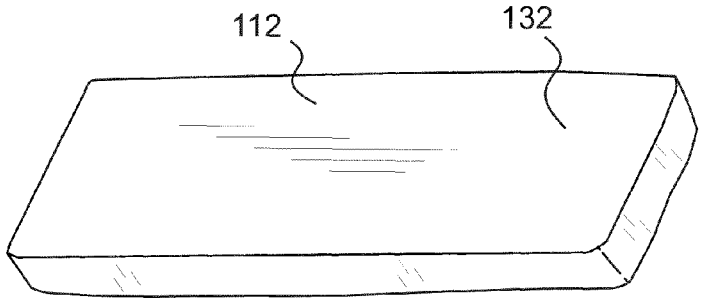
FIG. 4 is a diagrammatic perspective view showing the cushion member of the present invention in a flat position.
Figure 4B:
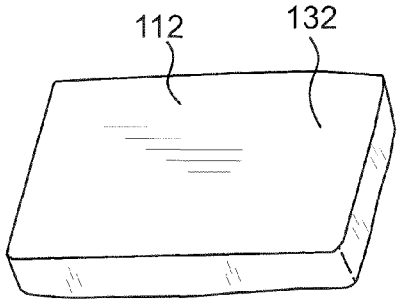

110 multiple function pillow
112 cushion member of pillow 110
114 protective cover of pillow 110
116 removably inserting mechanism of pillow 110
118 securing mechanism of pillow 110
120 wrist of person 122
122 person
124 strap of bag 126
126 bag
128 strap of purse 130
130 purse
132 durable thick foam material of cushion member 112
134 soft washable material of protective cover 114
136 decorative graphics on protective cover 114
138 longitudinal transparent zipper for removably inserting mechanism 116
140 rear face of protective cover 114
142 hook fastener strap of securing mechanism 118 (Velcro)
144 loop pile fastener strap of securing mechanism 118
146 non-slip neoprene material pad of pillow 110

DETAILED DESCRIPTION OF THE PREFERRED EMBODIMENT

Referring now to the figures, in which like numerals indicate like parts, and particularly to FIGS. 1 through 8, and as such, will be discussed with reference thereto.

Figure 5:
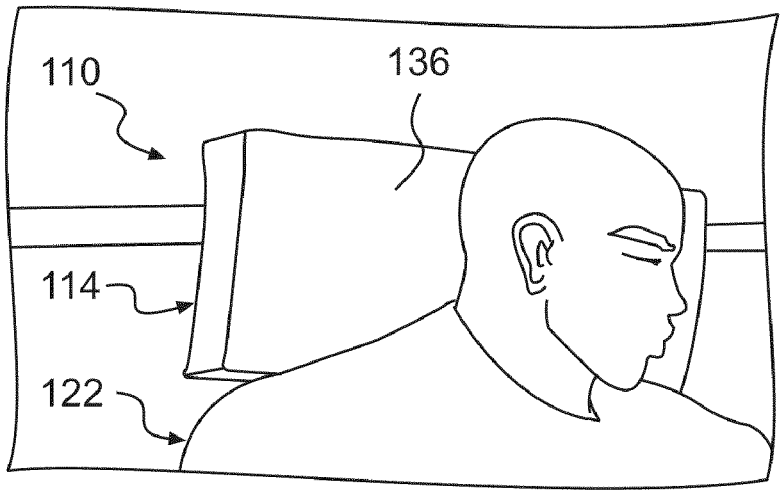
FIG. 5 is a diagrammatic perspective view showing the present invention being used to rest the head of the person.
Figure 6:
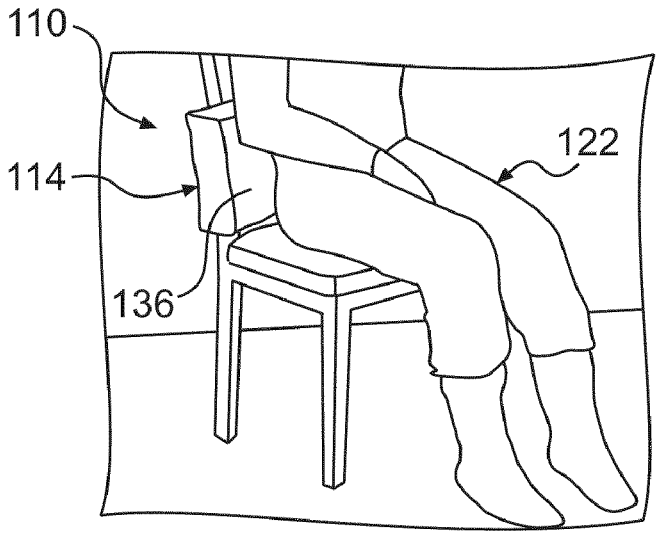
FIG. 6 is a diagrammatic perspective view showing the present invention being used to rest the back of the person.
Figure 7:
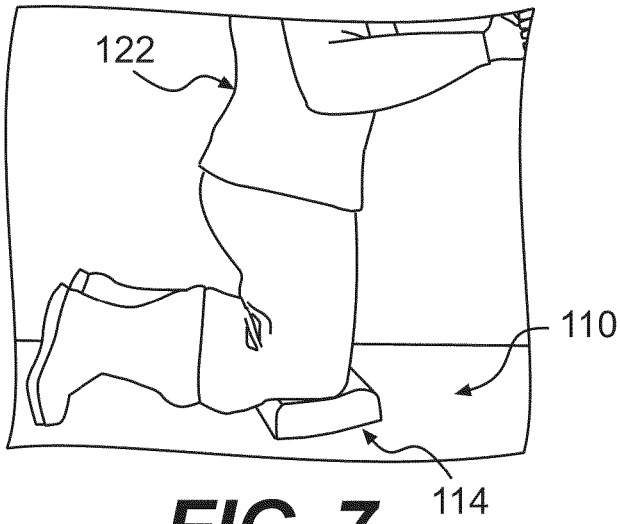
Figure 8:
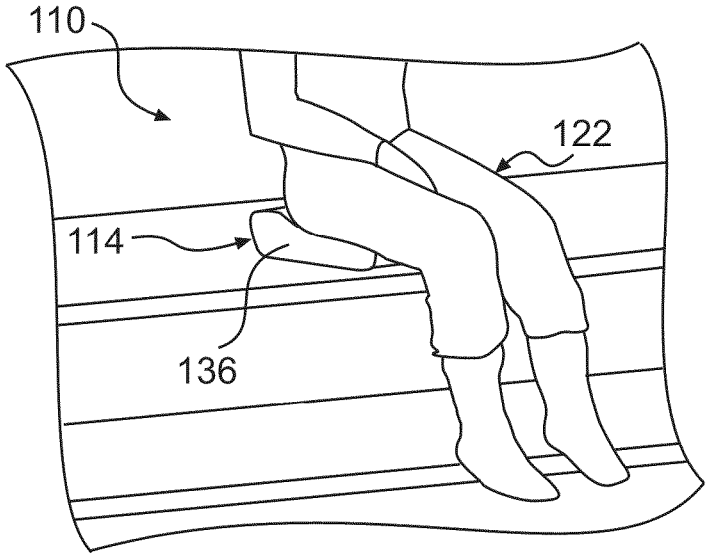

In FIGS. 1-4: a multiple function pillow 110 is used for kneeling, sitting, sleeping and traveling which comprises a cushion member 112 and a protective cover 114. A mechanism 116 is for removably inserting the cushion member 112 into the protective cover 114, to allow a person 122 to rest their head, back, sit and kneel thereon, as shown in FIGS. 5, 6, 7 and 8. In FIG. 5, the user 122 can use the pillow 110 to rest their head during traveling. In FIG. 6, the user 122 can use the pillow 110 to rest their back on a chair. In FIG. 7, the user 122 can use the pillow 110 to rest their knees in a yoga session or in a church session. In FIG. 8, the user 122 can use the pillow 110 (with protective cover 114 and decorative graphics 136 thereon) to sit on stadium's bench. A mechanism 118 is for securing opposite ends of the protective cover 114 together, wherein the cushion member 112 can be folded into a closed position, so as to be wrapped and retained about a wrist 120 of a person 122, a handle of a suitcase (not shown), a strap 124 of a bag 126 and a strap 128 of a purse 130 for easy transportation thereof, as shown in FIG. 1.

The cushion member 112 is rectangular shaped and is comprised out of a durable thick foam material 132. The foam 132 is select from a group consisting of polyalther thread, polyester thread and polyurethane. The protective cover 114 is rectangular shaped and is comprised out of a soft washable material 134. The protective cover 114 can also be comprised with decorative graphics 136 thereon, as shown in FIG. 1.

The removably inserting mechanism 116 comprises a longitudinal transparent zipper 138 on a rear face 140 of the protective cover 114 for opening the rear face 140 of the protective cover 114. The securing mechanism 118 comprises a set of complimentary hook and loop pile fastener straps 142, 144, with each located on an opposite end of the protective cover 114. It contains a longitudinal transparent zipper 138 located on the rear face 140 that may be opened and closed to insert or remove the cushion member 112. The rear face 140 also has two non-slip neoprene material pads 146 strategically placed on the protective cover 114 to prevent the pillow 110 from slipping on a flat surface. The neoprene material pads 146 enhances the friction and adhesion between the pillow 110 and the flat surface. The two non-slip neoprene material pads 146 are rectangular and vertical to the zipper's line of zipper 138.

The protective cover 114 with the cushion member 112 therein can measure approximately two inches in thickness, fifteen inches in length and eight inches in width. The protective cover 114 with the cushion member 112 therein can also measure approximately three inches in thickness, eighteen inches in length and eight inches in width.

In summary, the multiple function pillow 110 is a cushioning device designed to help minimize unnecessary pain users may experience during activities such as praying, sitting or sleeping. The pillow 110 comprises a cushion member 112 and a protective cover 114. The pillow 110 is rectangular in shape and can be available in two or more sizes to suit user preference. These aforementioned sizes may measure approximately 2"×15"×8" for a standard size and 3"×18"×8" for a larger version. The protective cover 114 can be made of fleece, cotton, or other suitable soft and washable material 134.

Further, the protective cover 114 comprises hook and loop pile fastener straps 142, 144 with each attached to an opposite end allowing the pillow 110 to be temporarily secured to luggage, bags or wrist 120 of a person 122. Additional hook and loop pile fastener straps can be incorporated on the protective cover 114 to allow the pillow 110 to be attached to seat rests for securement purposes. Colors, materials and other specifications may vary upon manufacturing.

It will be understood that each of the elements described above, or two or more together, may also find a useful application in other types of constructions differing from the types described above.

While the invention has been illustrated and described as embodiments of a multiple function pillow, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A multiple function pillow used for kneeling, sitting, sleeping and traveling which comprises:

a) a durable thick foam cushion member in a cross-sectional rectangular shape;

b) a soft washable protective cover in a cross-sectional rectangular shape;

c) a longitudinal transparent zipper for removably inserting the cushion member into the protective cover, and for allowing a person to see through the color and dirtiness of the cushion member when the transparent zipper in a closed position;

d) means for temporarily securing at opposite ends of the protective cover comprising a set of two complimentary hook and loop pile fastener elongated straps, wherein complimentary hook and loop located on the straps close to the opposite end points of the protective cover thereby facilitate in temporarily securing the opposite ends of protective cover of the cushion member together to fold into a closed position, so as to be wrapped and retained in an adjustable tightening with an adjustable length about a wrist of a person, a handle of a suitcase, a strap of a bag and a strap of a purse for easy transportation thereof.

2. The pillow as recited in claim 1, further comprising two non-slip neoprene material pads affixed onto the rear face of the protective cover which are spaced apart and located on opposite sides of the longitudinal transparent zipper, wherein the non-slip neoprene material pads will prevent the protective cover from slipping on the flat surface while providing additional support to the transparent zipper's ends.

3. The pillow as recited in claim 2, wherein the two non-slip neoprene material pads are rectangular and vertical to the zipper's line of the transparent zipper acting as covers to both of the knees of the user during kneeling.

4. The pillow as recited in claim 1, wherein the protective cover is comprised with decorative graphics thereon and the durable thick foam cushion member is select from a group consisting of polyurethane, polyalther thread and polyester thread.

5. The pillow as recited in claim 1, wherein the protective cover with the cushion member therein measures approximately two inches in thickness, fifteen inches in length and eight inches in width.

6. The pillow as recited in claim 1, wherein the protective cover with the cushion member therein measures approximately three inches in thickness, eighteen inches in length and eight inches in width.

* * * * *